United States Patent [19]

Schuman-Hoole

[11] 4,212,103

[45] Jul. 15, 1980

[54] RAZOR

[76] Inventor: April Schuman-Hoole, Box 791, Tenafly, N.J. 07670

[21] Appl. No.: 955,408

[22] Filed: Oct. 27, 1978

[51] Int. Cl.[2] ..... B26B 21/22

[52] U.S. Cl. ..... 30/32; 30/50

[58] Field of Search ..... 30/32, 50, 85, 51

[56] References Cited

U.S. PATENT DOCUMENTS

| | | | |
|---|---|---|---|
| 890,350 | 6/1908 | Fowler | 30/85 |
| 1,466,123 | 8/1923 | Everett | 30/32 |
| 2,405,200 | 8/1946 | Feldman | 30/32 X |
| 2,583,057 | 1/1952 | Leatherman | 30/32 |
| 3,378,922 | 4/1968 | Schrader | 30/32 X |

*Primary Examiner*—Jimmy C. Peters

*Attorney, Agent, or Firm*—B. J. Powell

[57] ABSTRACT

A razor including a razor head with a razor blade mounted in the razor head for shaving and a handle connected to the razor head adapted to be used to support said razor during shaving where the handle defines a viewing opening therethrough immediately behind the back side of the razor head to allow the user to view the skin area being shaved immediately ahead of razor head during use and to allow the razors to nest within each other for packaging.

4 Claims, 11 Drawing Figures

RAZOR

BACKGROUND OF THE INVENTION

Safety razors are well known and come in a variety of shapes and sizes. By and large, these prior art safety razor constructions all include a handle which mounts a razor head at one end of the handle. Generally, these handles are attached to or carry the razor head at a position centrally of the length of the razor head so that the razor head projects outwardly on opposite sides of the handle. Several common problems have been associated with these prior art razor constructions.

One of these problems is that it is difficult to see the skin area that is being shaved immediately ahead of the razor head during use. This has been particularly a problem in the shaving of the skin areas prior to surgery where the shaving is generally done by hospital personnel. Because the skin areas being shaved prior to surgery many times occupy sensitive body areas which are relatively complex in shape, it is extremely difficult to shave the desired skin area for surgery without unnecessarily cutting the skin area being shaved. This, of course, is highly undesirable since damage to the skin area around the point of surgery many times promotes infection and makes surgical procedures more difficult to carry out.

Another of the problems with prior art razors is that the handle construction is such that the razor is generally unstable during the shaving operation. Moreover, the handle construction is such that the user's hand becomes tired because of the unnatural gripping position required by the prior art razor construction during shaving, especially if the shaving operation requires any significant period of time. Because the prior art razor handles join with the razor head centrally thereof, it has been difficult for the user to apply the razor to the area being shaved while maintaining an evenly distributed pressure along the length of the razor blade.

Yet another problem with these prior art razors is that packaging the razors for merchandising is extremely difficult since the razors will not nest within each other to minimize the packaging problems associated therewith. This problem is even further enhanced because the shape of the razor is such that simplified packaging generally cannot be used in a merchandising program. This problem has become even more acute with the advent of disposable safety razors.

Still another problem associated with prior art razors is that they have been difficult to clean. This is especially a problem in the area where the handle joins with the razor head. Both the shaved hair and the lathering material tend to collect between the back side of the razor head and the handle and are difficult to dislodge. This not only causes the razor to be unsanitary but also blinds this portion of the blade area to reduce its shaving efficiency and retains moisture in this portion of the blade area to speed the corrosion thereof.

SUMMARY OF THE INVENTION

These and other problems and disadvantages associated with the prior art are overcome by the razor construction disclosed herein which provides a substantially unrestricted viewing area through the razor itself ahead of the razor head so that the user can view the skin area being shaved immediately ahead of the razor head during use. While the appropriate anthropomorphic angle is provided in the razor handle to facilitate the usage thereof, a viewing area is provided through the handle immediately ahead of the razor head either by defining an opening through the handle or by defining a transparent section through the handle so that the user can see the skin area immediately ahead of the razor head. This allows the razor handle to be wider than normally associated with the prior art razors since the handle extends to opposite ends of the razor head rather than to its center to facilitate the gripping of the razor handle while a finger opening is provided through the handle to intermediate its ends to further facilitate the user grasping the handle during use. Because the handle extends to opposite ends of the razor head, the user applies pressure at two spaced points along the razor head rather than a single point as in the prior art thereby greatly facilitating the even distribution of the pressure between the razor head and the skin area being shaved along the length of the razor head. Also, because the handle joins the razor head at its opposite ends outboard of the razor blades, that area of the razor head behind the razor blades is exposed for ease in cleaning and drying.

The invention further overcomes the nesting problems associated with the prior art by providing an opening through the handle adjacent the razor head so that, when the razors are coaxially aligned, the handle of one of the razors can be inserted through the handle opening of another of the razors. When two of the razors are reversed in direction and coaxially aligned, the handles of each of the razors will project through the opening in the handle of the other razor in order that the razors will nest within each other and can be stacked on a common surface plane. It will also be noted that when the razors are oriented in the same direction, the handle of the razor can be inserted through the opening in the handle of another of the razors so that again the razors nest within each other and can be supported on a common plane surface.

These and other features and advantages of the invention disclosed herein will become more apparent upon consideration of the following description and accompanying drawings wherein like characters of reference designate corresponding parts throughout the several views and in which:

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Figure 1:
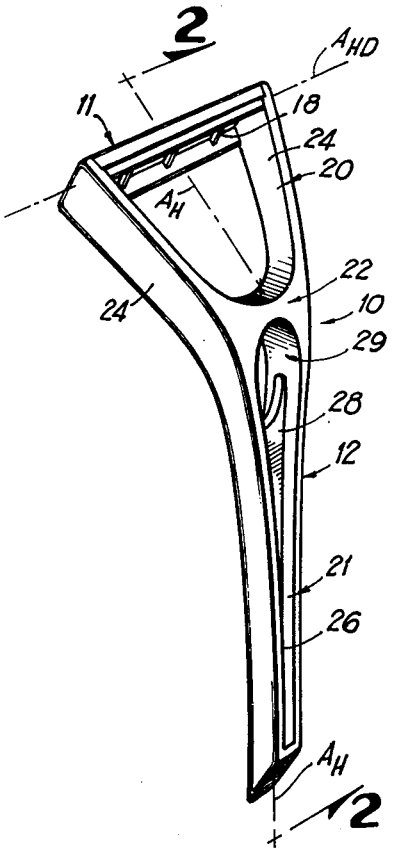
FIG. 1 is a perspective view of a razor construction embodied in the invention.

FIGS. 1–3 and 6–9 illustrate a first embodiment of the invention. The razor construction has been designated by the reference numeral 10 and includes generally a razor head 11 and a handle 12. The razor head 11 is of conventional construction and usually has one or more razor blades 14 mounted therein, each defining a cutting edge 15 thereon on the front side 16 of the razor head 11. The back side 18 of the razor head 11 faces the handle 12. The razor head 11 is arranged so that its longitudinal axis $A_{HD}$ is generally normal to the handle axis $A_H$ as best seen in FIG. 1.

Figure 2:
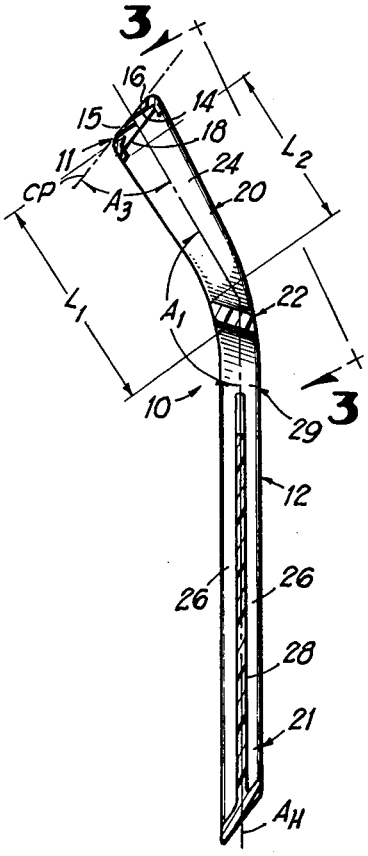
FIG. 2 is a longitudinal cross-sectional view taken generally along line 2—2 in FIG. 1.

The handle 12 includes a head carrying section 20 and a gripping section 21 which are integral with each other at a common juncture 22 with the head carrying section 20 mounting the razor head 11 thereon at that end opposite the juncture 22. The head carrying section 20 is angled with respect to the gripping section 21 with an angle $A_1$ therebetween as best seen in FIG. 2 and has an effective length $L_1$. The angle $A_1$ is the normal anthropomorphic angle usually associated with razor handles and is illustrated at about 145°. The anthropomorphic angle $A_1$ is designed to facilitate the gripping and positioning of the razor construction 10 by the human hand.

Figure 3:
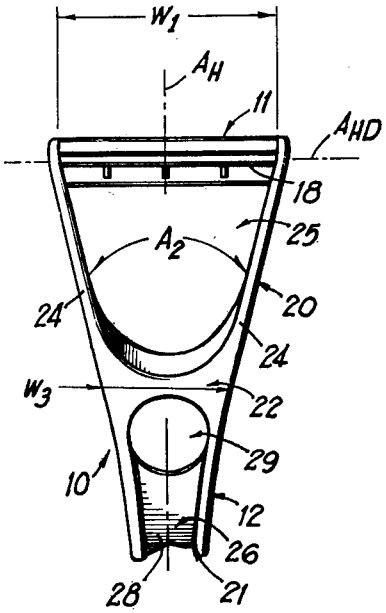
FIG. 3 is a plan view taken generally along line 3—3 in FIG. 2.

The head carrying section 20 includes a pair of spaced apart head mounting legs 24 which angle away from each other with the angle $A_2$ as best seen in FIG. 3 so that the legs 24 angle equally outwardly from the handle axis $A_H$ on opposite sides thereof. The projecting ends of the legs 24 mount the razor head 11 therebetween and the opposite ends of the legs 24 are integrally joined with the gripping section 21 of the handle 12 at the juncture 22. Thus, it will be seen that the legs 24 define a viewing opening 25 therebetween with a maximum width $W_1$ at head 11 and a length $L_2$ bounded by the legs 24, the juncture 22 between the head carrying section 20 and the gripping section 21, and by the razor head 11. Since the gripping section 21 angles downwardly and away from the skin area which is to be shaved by the razor head 11, it will be seen that the viewing opening 25 exposes the skin area to be shaved to the view of the person using the razor. It will also be noted that the cutting plane CP of the razor head 11 along which the razor head axis $A_{HD}$ extends is angled with respect to the handle axis $A_H$ by the angle $A_3$. Because the cutting plane CP is not perpendicular to the handle axis $A_H$, it will be seen that the handle 12 is always oriented so that the viewing opening 25 exposes the skin area to be shaved immediately ahead of the razor head 11 to the view of the user. Thus, the user is always able to both accurately position the shaving head 11 for shaving and to accurately control the shaving head 11 during the shaving operation.

The gripping section 21 is illustrated as defining a recess 26 therein from opposite sides thereof extending generally along the length of the gripping section 21 so that the handle 12 has its maximum solid thickness at the juncture 22 between the head carrying section 20 and the gripping section 21 to insure proper strength in the razor handle 12. The gripping section 21 tapers smoothly outwardly from a minimum width $W_2$ at its projecting end to a maximum width $W_3$ at juncture 22. It will further be noted that the recesses 26 define a central web 28 therebetween to further reinforce the gripping section 21. That end of the central web 28 adjacent the juncture 22 is provided with a finger cutout 29 through which the user can insert his finger while gripping the razor to steady the razor. Further, it will be noted that both the juncture 22 and the legs 24 provide much wider spaced gripping points than those associated with prior art razors so that the user can grip these areas of the handle 12 to further steady the razor.

Figure 4:
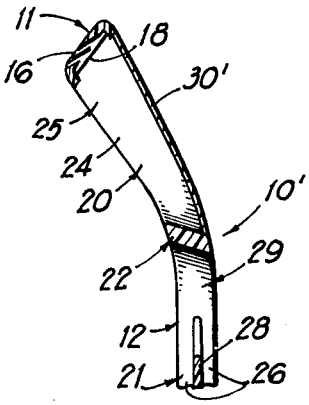
FIG. 4 is a view similar to FIG. 3 showing a first modification of the invention.

FIG. 4 shows a modification to that embodiment of the razor seen in FIGS. 1–3 designated 10'. Those portions of the modified razor 10' in FIG. 4 which correspond to the portions of the razor 10 have the same numbers applied thereto. The only difference between the razor 10 of FIGS. 1–3 and the razor 10' of FIG. 4 is that the razor 10' has a transparent cover member 30' which extends over the top of the opening 25 between the legs 24 to prevent the user sticking his hand through the opening 25 to interfere with the action of the razor head 11 yet still allows the user to view the skin area being shaved immediately ahead of the head 11.

Figure 5:
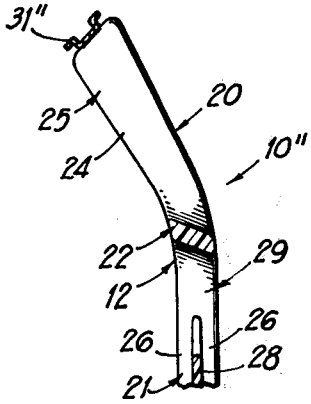
FIG. 5 is a view similar to FIG. 3 showing a second modification of the invention.

FIG. 5 illustrates a second modification of the razor seen in FIGS. 1–3 and has been designated generally by the numeral 10''. The modified razor 10'' is designed for use with the disposable cartridge type shaving heads (not shown) of standard construction. The projecting ends of the legs 24 are provided with a generally U-shaped cartridge holder 31'' which extends therebetween and over which the standard cartridge type razor head is inserted to position the cartridge type razor head on the razor 10''.

Figure 6:
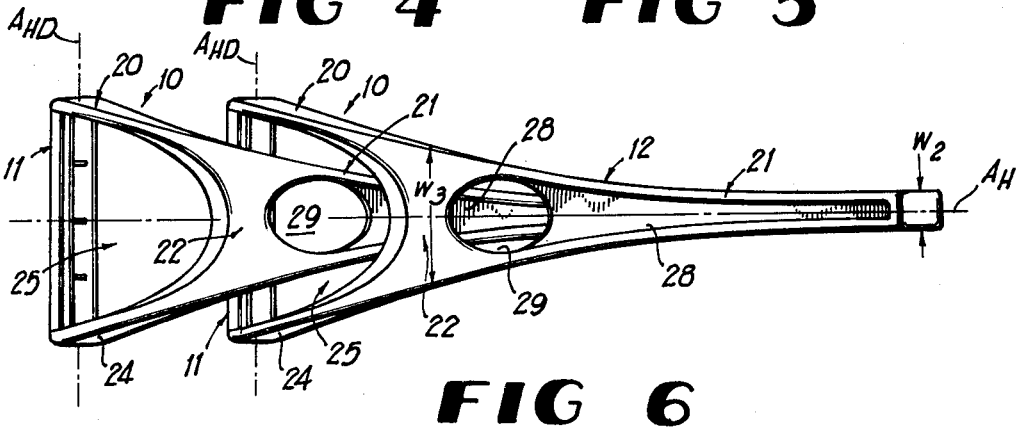
FIG. 6 is a top plan view illustrating a first nesting arrangement of the razor construction seen in FIG. 1.
Figure 7:
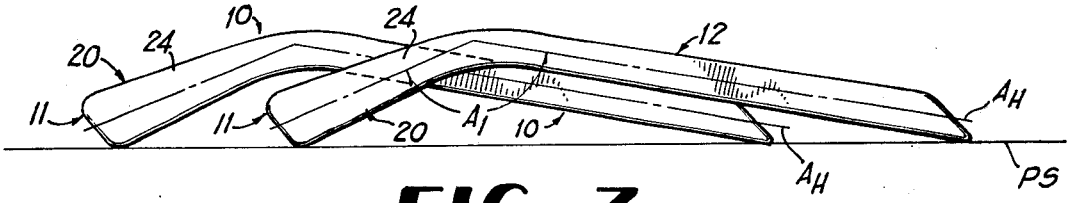
FIG. 7 is a side view of FIG. 6.
Figure 8:
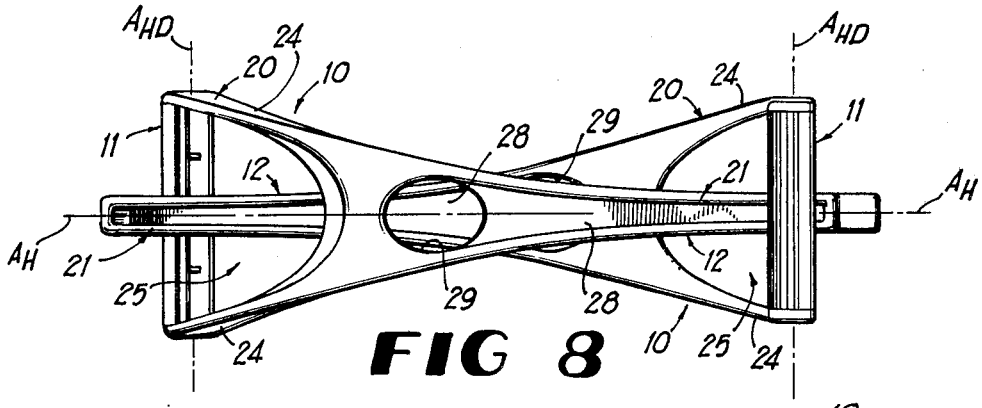
FIG. 8 is a top plan view of the razors shown in FIG. 1 arranged in a second nesting configuration.
Figure 9:
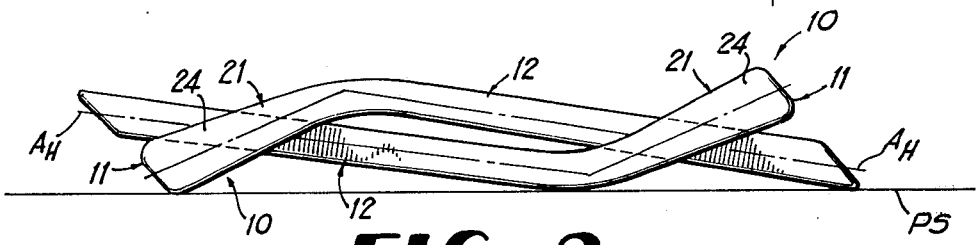
FIG. 9 is a side view of FIG. 8.

FIGS. 6 and 7 illustrate a first nesting arrangement of the razors 10 while FIGS. 8 and 9 illustrate a second nesting arrangement of the razors 10. It will be noted that in both instances that the razors 10 are oriented so that the handle axes $A_H$ are about coaxial.

In FIGS. 6 and 7, the razors 10 are oriented so that the razor head 11 of both razors face in the same direction and the angles $A_1$ in the handle 12 are both oriented in the same direction. It will thus be seen that the projecting end of the gripping section 21 on the handle 12 of one of the razors 10 (the inserted razor) is inserted through the opening 25 in the other razor 10 (the receiving razor) so that the gripping section of the inserted razor extends under the gripping section 21 of the receiving razor. As best seen in FIG. 7, it will be seen that the common plane surface PS will support both razors by the handle 12 both at the razor head 11 and the projecting end of the gripping section of the handle 12. It is also understood that additional razors could be inserted onto the arrangement shown in FIGS. 6 and 7 since the size of the opening 25 is sufficient to receive two of the gripping sections 21 therethrough. Thus, it is the combination of the length $L_1$ of the opening 25 together with the angle $A_1$ between the gripping section 21 and the head carrying section 20 as well as the width of the gripping section 21 that permits the razors 10 to be nested in the configuration seen in FIGS. 6 and 7. Since both of the razors 10 are supported on the same common plane surface, packaging is extremely easy since the razors 10 may simply be bound to the plane surface PS or a blister pack may be made therefrom.

In FIGS. 8 and 9, the razors 10 are still coaxially aligned but the razor heads 11 face in opposite directions. Not only do the razor heads 11 face in an opposite direction, the angle $A_1$ in the handles 12 also face in opposite directions. In this manner, it will be seen that the gripping section 21 of each razor can be inserted through the opening 25 in the other razor 10 so that each of the gripping sections 21 extend through the opening 25 in the other razor handle 12. The common plane surface PS supports one of the razors 10 (the upright razor) as best seen in FIG. 9 by engaging the handle 12 adjacent the razor head 11 at one end thereof and engaging the projecting end of the gripping section 21 at the opposite end thereof. The other razor 10 (the inverted razor) is supported by the plane surface PS by engaging the handle 12 at the juncture 22. The inverted razor 10 supported on the plane surface PS at the juncture 22 is also supported by the upright razor 10 by the gripping section 21 engaging the back side 18 of the razor head 11 of the upright razor 10 while the back side 18 of the razor head 11 on the inverted razor 10 may be supported by its engaging the gripping section 21 of the upright razor 10. Packaging can be completed similarly to that explained for FIGS. 6 and 7.

Figure 10:
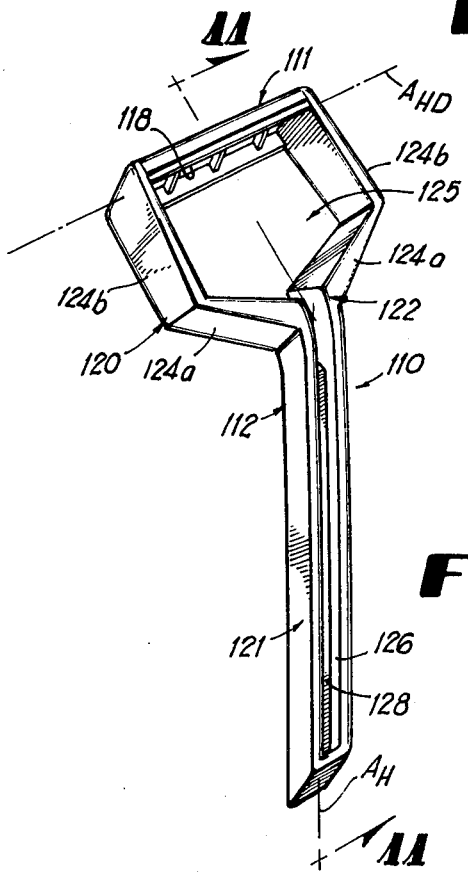
FIG. 10 is a perspective view of a second embodiment of a razor construction embodying the invention.
Figure 11:
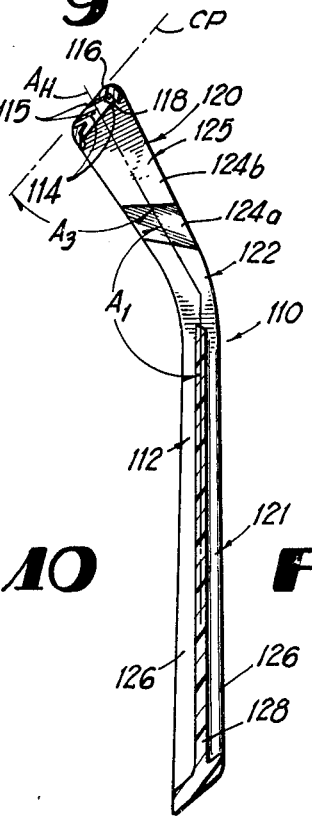
FIG. 11 is a longitudinal cross-sectional view taken along line 11—11 in FIG. 10.

FIGS. 10 and 11 illustrate a second embodiment of the invention. The razor construction has been designated by the reference numeral 110 and includes generally a razor head 111 and a handle 112. The razor head 111, like razor head 11, is of conventional construction with one or more razor blades 114 mounted therein, each defining a cutting edge 115 thereon on the front side 116 of the razor head 111. The back side 118 of the razor head 111 faces the handle 112. The razor head 111 is arranged so that its axis $A_{HD}$ is generally normal to the handle axis $A_H$ as best seen in FIG. 10.

The handle 112 includes a head carrying section 120 and a gripping section 121 which are integral with each other at a common juncture 122 with the head carrying section 120 mounting the razor head 111 thereon at that end opposite the juncture 122. The head carrying section 120 is angled with respect to the gripping section 121 with an angle $A_1$ therebetween as best seen in FIG. 11. The angle $A_1$ is the normal anthropomorphic angle associated with razor handles the same as for razor 10.

The head carrying section 120 includes a pair of diverging spacing legs **124*a* which extend from juncture 122 and angle away from each other as best seen in FIG. 10 so that the legs 124*a* angle outwardly from the handle axis $A_H$ on opposite sides thereof. The projecting ends of the legs 124*a* mount a pair of spaced apart, forwardly projecting mounting legs 124*b* which mount razor head 11 therebetween at the projecting ends thereof. Thus, it will be seen that the legs 124*a* and 124*b* define a viewing opening 125 therebetween bounded by the legs 124*a* and 124*b* the juncture 122 between the head carrying section 120 and the gripping section 121, and by the razor head 111. Since the gripping section 121 angles downwardly and away from the skin area which is to be shaved by the razor head 111, it will be seen that the viewing opening 125 exposes the skin area to be shaved to the view of the person using the razor, especially since the cutting plane CP of the razor head 11 is angled with respect to the handle axis $A_H$ by the angle $A_3$. Because the cutting plane CP is not perpendicular to the handle axis $A_H$, it will be seen that the handle 112 is always oriented so that the viewing opening 125 always exposes the skin area to be shaved immediately ahead of the razor head 111 to the view of the user. Thus, the user is always able to both accurately position the shaving head 111 for shaving and to accurately control the shaving head 111** during the shaving operation.

The gripping section 121 is illustrated as defining recesses 126 therein from opposite sides thereof extending generally along the length of the gripping section 121 to define a central web 128 therebetween to reinforce the gripping section 121. It will also be noted that both the juncture 122 and the legs **124*a* and 124*b* provide much wider gripping points than those associated with prior art razors so that the user can grip these areas of the handle 112** to further steady the razor.

What is claimed as invention is:

1. A handle construction mounting a razor head having at least one razor blade mounted within the razor head with a cutting edge projected from one side of the razor head for shaving, said handle construction including a handle adapted to be manually gripped to support the razor head during shaving, said handle including a head carrying section mounting the razor head thereon and a gripping section integral with that end of said head carrying section opposite the razor head and angled with respect to said head carrying section, said head carrying section including a pair of spaced apart legs extending from the juncture between said head carrying and gripping sections to opposite ends of the razor head to define an opening therebetween immediately ahead of the razor head, said head carrying section further including a transparent member extending between said mounting legs of said head carrying section of said handle along that end of said opening opposite the cutting edge of the razor blade to close said opening so that material removed during shaving can accumulate within said opening under said transparent member, yet the user can view the skin area being shaved immediately ahead of the razor head through said transparent member.

2. The handle construction of claim 1 wherein said gripping section includes a finger opening therethrough adjacent the juncture between said first and second sections to facilitate the user gripping said second gripping section of said handle during the use.

3. The handle construction of claim 1 wherein said mounting legs fixedly mount the razor head therebetween.

4. The handle construction of claim 1 wherein said mounting legs removably mount the razor head therebetween.

* * * * *